US007954568B2

(12) United States Patent
Bilen

(10) Patent No.: US 7,954,568 B2
(45) Date of Patent: Jun. 7, 2011

(54) DRILL BIT NOZZLE ASSEMBLY AND INSERT ASSEMBLY INCLUDING A DRILL BIT NOZZLE ASSEMBLY

(75) Inventor: Juan Miguel Bilen, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 727 days.

(21) Appl. No.: 11/600,304

(22) Filed: Nov. 15, 2006

(65) Prior Publication Data

US 2008/0110680 A1 May 15, 2008

(51) Int. Cl.
*E21B 10/18* (2006.01)

(52) U.S. Cl. ..... 175/340; 175/393; 175/429; 175/424

(58) Field of Classification Search ..... 175/340, 175/393, 429, 424; 239/591
See application file for complete search history.

(56) References Cited

U.S. PATENT DOCUMENTS

| | | | | |
|---|---|---|---|---|
| 4,711,311 | A | 12/1987 | Underwood et al. | |
| 4,793,426 | A | 12/1988 | Millsapps, Jr. | |
| 5,538,093 | A * | 7/1996 | Siracki et al. | 175/393 |
| 5,678,645 | A | 10/1997 | Tibbitts et al. | |
| 6,227,316 | B1 * | 5/2001 | Rohde | 175/340 |
| 6,230,822 | B1 | 5/2001 | Sullivan et al. | |
| 6,311,793 | B1 * | 11/2001 | Larsen et al. | 175/340 |
| 6,655,481 | B2 | 12/2003 | Findley et al. | |
| 7,048,081 | B2 | 5/2006 | Smith et al. | |
| 7,188,682 | B2 * | 3/2007 | Larsen et al. | 175/57 |
| 2004/0069534 | A1 * | 4/2004 | Larsen et al. | 175/57 |
| 2006/0266557 | A1 * | 11/2006 | Estes | 175/340 |

FOREIGN PATENT DOCUMENTS

| | | |
|---|---|---|
| FR | 2272255 | 12/1975 |
| GB | 2330163 A | 4/1999 |
| RU | 2279526 C1 | 7/2006 |

OTHER PUBLICATIONS

PCT International Search Report for counterpart PCT International Application No. PCT/US2007/023902, mailed Apr. 11, 2008.

* cited by examiner

*Primary Examiner* — Daniel P Stephenson
*Assistant Examiner* — Elizabeth C Gottlieb
(74) *Attorney, Agent, or Firm* — TraskBritt

(57) ABSTRACT

A steel body bit nozzle assembly comprising a bit body having a port therein with a sleeve disposed adjacent a nozzle in the port and an annular seal disposed between an outer wall, each of the sleeve and the nozzle and a wall of the port, each seal being received and compressed in an annular seal groove located between its respective component and the bit body. A nozzle pocket insert assembly and a method of manufacturing or retrofitting a steel body bit for use of the nozzle pocket insert assembly are also disclosed.

20 Claims, 8 Drawing Sheets

DRILL BIT NOZZLE ASSEMBLY AND INSERT ASSEMBLY INCLUDING A DRILL BIT NOZZLE ASSEMBLY

BACKGROUND OF THE INVENTION

1. Field of the Invention

The present invention, in various embodiments, relates to drill bits for subterranean drilling and, more particularly, to a nozzle and sleeve assembly therefor, including an insert assembly including the nozzle and sleeve assembly and a method of manufacturing or retrofitting drill bits with the insert assembly.

2. State of the Art

Drill bits for subterranean drilling, such as drilling for hydrocarbon deposits in the form of oil and gas, conventionally include internal passages for delivering a solids-laden drilling fluid, or "mud," to locations proximate a cutting structure carried by the bit. In fixed cutter, or so-called "drag" bits, the internal passages terminate proximate the bit face at locations of nozzles received in the bit body for controlling the flow of drilling mud used to cool the cutting structures (conventionally polycrystalline diamond compact (PDC) or other superabrasive cutting elements). Some drag bits, termed "matrix" bits, are fabricated using particulate tungsten carbide infiltrated with a molten metal alloy, commonly copper-based. Other drag bits comprise steel bodies machined from castings. Steel body drag bits are susceptible to erosion from high pressure, high flow rate drilling fluids, on both the face of the bit and the junk slots as well as internally. As a consequence, on the bit face and in other high-erosion areas, hardfacing is conventionally applied. Within the bit, erosion-resistant components such as nozzles and sleeves fabricated from tungsten carbide or other erosion-resistant materials are employed to protect the steel of the bit body.

As shown in FIG. 8 of the drawings, a conventional steel body bit 500 for use in subterranean drilling includes a plurality of nozzle assemblies, exemplified by illustrated nozzle assembly 501. The nozzle assembly 501 is a two-piece replaceable nozzle assembly, the first piece being a tubular tungsten carbide nozzle sleeve 502 that fits into a port 504 machined in the steel body bit 500, and is seated upon an annular shoulder 505 of port 504. The second piece is a tungsten carbide nozzle 503 having a restricted bore 513 that secures and retains the nozzle sleeve 502 within port 504 of the steel body bit 500 by threads 506, which engage mating threads on the wall of port 504. The sleeve 502 and the nozzle 503 are used to provide protection to the steel of steel body bit 500 through which port 504 extends against erosive drilling fluid effects by providing a hard, abrasion and erosion-resistant pathway from an inlet fluid chamber or center plenum 507 within the bit body to a nozzle exit 508. The nozzle sleeve 502 and nozzle 503 are replaceable should the drilling fluid erode or wear the parts within internal passage 509 extending through these components, or when a nozzle 503 having a different orifice size is desired; however, it is intended that the nozzle sleeve 502 and nozzle 503 will protect the surrounding steel of the bit body from all erosion.

When drilling fluid is present in the fluid chamber 507 when drilling is being conducted, it is under a pressure P1 that is greater than the pressure P2 in the passage 509 or at the nozzle exit 508. In order to prevent fluid flow under pressure P1 from bypassing passage 509, the nozzle 503 is formed as a replaceable piece that has threads 506, wherein the bottom of nozzle 503 is designed to seat on the top of sleeve 502 as threads 506 are made up with those on the wall of port 504. Annular flange of sleeve 502 is designed to seat upon annular shoulder 505 of the body of bit 500, so that the components arranged as shown in FIG. 8 prevent fluid flow and associated erosion from occurring through the junctions 510, 511, 512 between components. Further, the outer surface or wall of the nozzle 503 is in sealing contact with a compressed O-ring 514 disposed in an annular groove formed in the wall of port 504 to provide a fluid seal between the body bit 500 and the nozzle 503. The junctions 510, 511, 512 are filled with a joint compound (not shown), such as BAKER-LOK® compound, in order to fill and seal any gaps. However, while it is undesirable that fluid flow in gaps provided by imperfect junctions 510, 511, 512, erosion from such flow around the exterior of sleeve 502 due to the pressure differential between P1 and P2 has been observed therein due to variations in component dimensional tolerances, the failure of the joint compound to fill any gaps attributable to such variations, and the failure of O-ring 514 to provide any sealing effect for the sleeve 502 and its junction 511 with the nozzle 503 and at annular shoulder 505.

Accordingly, it would be desirable to design and provide a nozzle assembly that is more robust in the drilling fluid flow, pressure and composition conditions that are encountered in subterranean drilling operations. It would also be advantageous to provide a nozzle assembly of a design that is suitable for both replacement and retrofit applications for existing steel body bits as well as in the manufacture of new steel body bits without requiring complicated and costly manufacturing or remanufacturing techniques. It would also be advantageous to provide a nozzle assembly that reduces or eliminates the need for joint compound.

BRIEF SUMMARY OF THE INVENTION

In one embodiment, a steel body bit nozzle assembly is provided which provides superior sealing and protection to the bit body under the drilling fluid flow, pressure and composition conditions that are encountered in subterranean drilling operations. The nozzle assembly eliminates the need for joint compound.

Another embodiment comprises a nozzle pocket insert assembly which is suitable for replacement or retrofit applications as well as in the manufacture of new steel body bits and which is of simple design and is straightforward to implement.

A steel body bit nozzle assembly includes a bit body having a port extending from an interior of the bit body to an exterior surface, a tubular sleeve of erosion-resistant material and a tubular nozzle of erosion-resistant material disposed in longitudinally adjacent relationship within the port, a plurality of annular grooves extending circumferentially around the port and at least one seal disposed in each annular groove. One annular groove is formed in at least one of the wall of the port and the outer wall of the nozzle and another annular groove is formed in at least one of the wall of the port and the outer wall of the sleeve, at least one seal being disposed in the one annular groove to provide a fluid seal between the wall of the port and the outer wall of the nozzle, and at least another seal being disposed in the another annular groove to provide a fluid seal between the wall of the port and the outer wall of the sleeve.

A nozzle pocket insert assembly comprises a tubular outer sleeve for fixed disposition in an enlarged port, termed a "pocket," of a steel body bit and having a threaded interior surface on an inner wall thereof for engaging exterior threads of a nozzle and two longitudinally spaced annular grooves in the inner wall longitudinally on the same side of the threaded interior surface. The tubular outer sleeve is secured within the pocket of the bit body. A tubular sleeve of erosion-resistant material is disposed within the tubular outer sleeve and a fluid seal therebetween provided by an O-ring disposed in one annular groove, and a tubular nozzle of an erosion-resistant material having a threaded exterior surface engaged with the threaded interior surface of the tubular outer sleeve is disposed within the tubular outer sleeve and a fluid seal provided between the tubular outer sleeve and tubular inner sleeve by an O-ring disposed in the other annular groove.

In another embodiment, a method of retrofitting or manufacturing a steel body bit is provided.

Other advantages and features of the present invention will become apparent when viewed in light of the detailed description of the various embodiments of the invention when taken in conjunction with the attached drawings and appended claims.

DETAILED DESCRIPTION OF THE INVENTION

Figure 1:
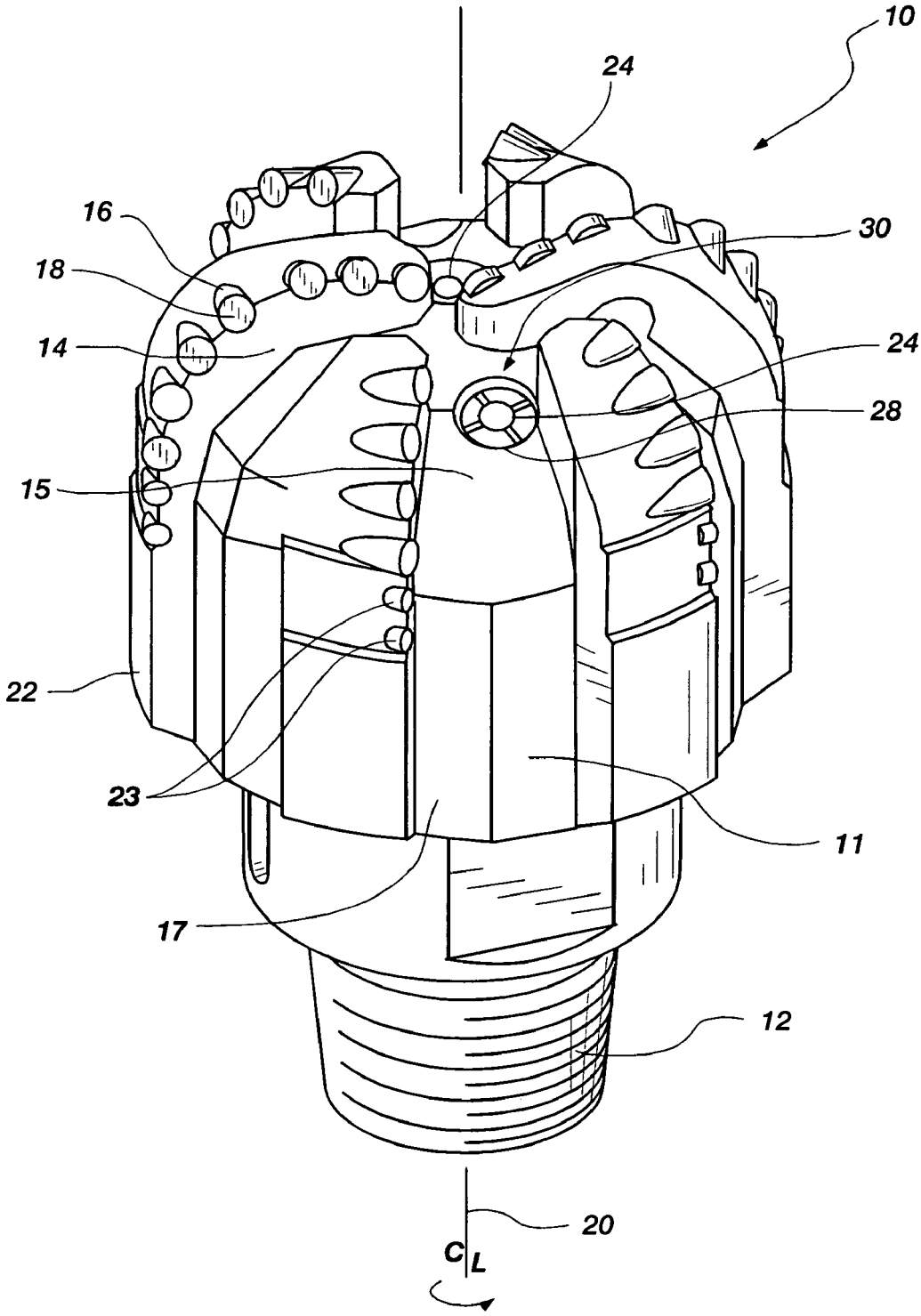
FIG. 1 shows a perspective, inverted view of a steel body drag bit incorporating a nozzle assembly according to an embodiment of the invention.

In the description that follows, like elements and features among the various drawing figures are identified for convenience with the same or similar reference numerals.

FIG. 1 shows a steel body drill bit 10 incorporating a plurality of nozzle assemblies 30 according to one or more embodiments of the invention. The steel body drill bit 10 is configured as a rotary full bore drill bit known in the art as a drag bit. The drill bit 10 includes bit body 11, which is conventionally machined from a steel casting. The bit 10 includes conventional male threads 12 configured to API standards and adapted for connection to a component of a drill string, not shown. The face 14 of the bit body 11 has mounted thereon a plurality of cutting elements 16, each comprising polycrystalline diamond compact (PDC) table 18 formed on a cemented tungsten carbide substrate. The cutting elements 16 are positioned to cut a subterranean formation being drilled while the drill bit 10 is rotated under weight on bit (WOB) in a bore hole about centerline 20. The bit body 11 may include gage trimmers 23 including the aforementioned PDC tables 18 configured with a flat edge (not shown) to trim and hold the gage diameter of the bore hole, and pads 22 on the gage, which contact the walls of the bore hole and stabilize the bit 10 in the hole.

During drilling, drilling fluid is discharged through nozzle assemblies 30 located in nozzle ports 28 in fluid communication with the face 14 of bit body 11 for cooling the PDC tables 18 of cutting elements 16 and removing formation cuttings from the face 14 of drill bit 10 into passages 15 and junk slots 17. The apertures 24 of nozzle assemblies 30 may be sized for different fluid flow rates depending upon the desired flushing required at each group of cutting elements 16 to which a particular nozzle assembly directs drilling fluid. The inventive nozzle assembly of the invention may be utilized with new drill bits, or with refurbished drill bits that are appropriately modified. Use of a nozzle assembly 30 with a steel body drill bit 10 as described herein enables improved removal and installation of nozzles in the field, and prevents unwanted washout or erosion of the nozzle assembly 30, including the components of the nozzle assembly that may be caused by drilling fluid flow.

Figure 2:
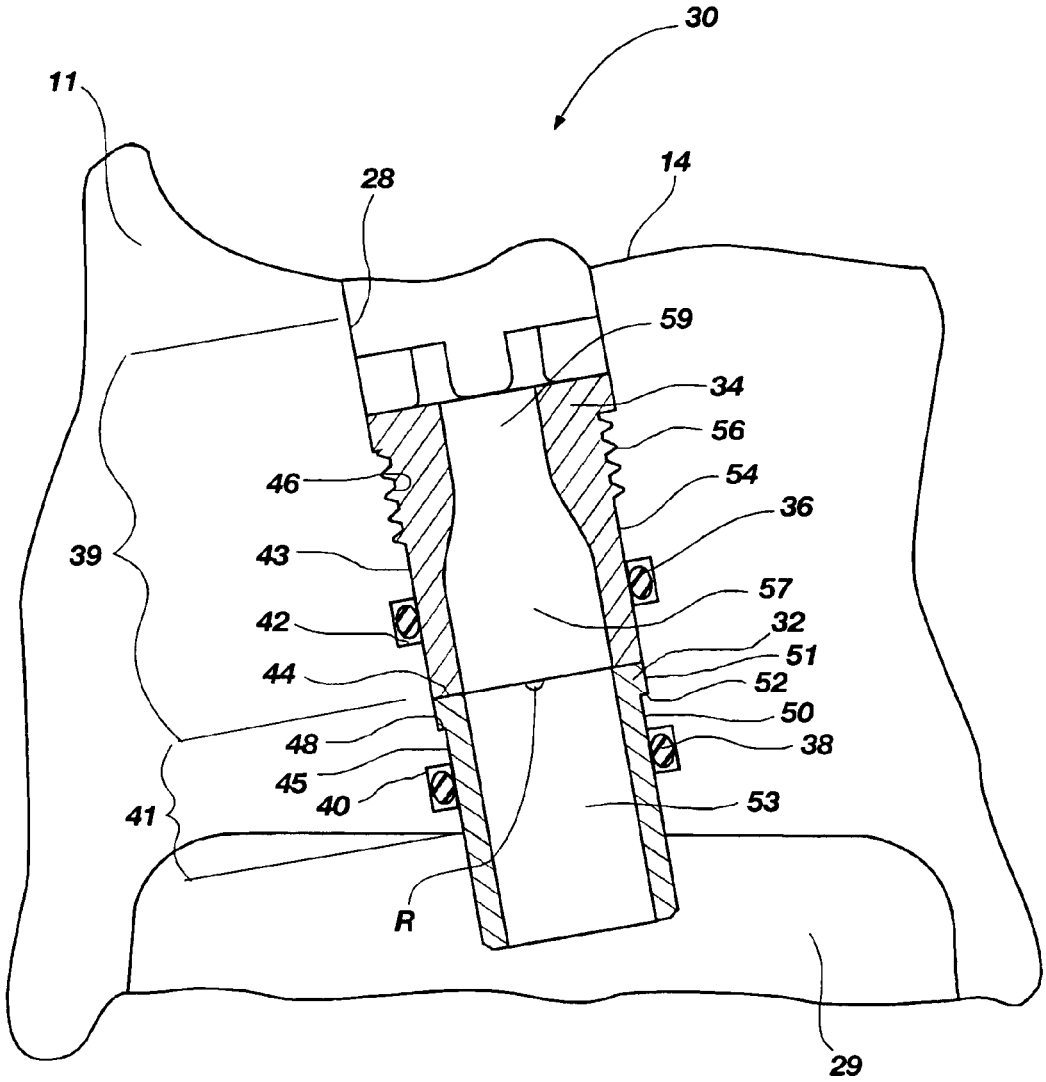
FIG. 2 shows a partial cross-sectional view of an embodiment of a nozzle assembly according to the invention.

FIG. 2 shows a partial cross-sectional view of an embodiment of the nozzle assembly 30. The nozzle assembly 30 in this embodiment includes a sleeve 32, a nozzle 34 and two O-ring seals 36, 38 that may be received within a nozzle port 28 of the bit body 11. The nozzle port 28 includes internal threads 46, an annular shoulder 48, a sleeve or first annular seal groove 40, and a nozzle or second annular seal groove 42. The nozzle port 28 provides a socket in which components of a nozzle assembly 30 are received for communication of drilling fluid from chamber or plenum 29 within the bit body 11 to the face 14 of the drill bit 10. The first seal groove 40 is circumferentially located in a lower portion 41 of the nozzle port 28 and may receive the seal 38. The second seal groove 42 is circumferentially located in an upper portion 39 of the nozzle port 28 and may receive the seal 36. The internal threads 46 are located above the first and second seal grooves 40, 42 in upper portion 39 of the nozzle port 28 proximate bit face 14 and are configured for engaging threads of a nozzle 34, described below.

Sleeve 32 includes an outer wall 50, a flange 51 at one end thereof including annular shoulder 52 and an internal passageway or bore 53 therethrough. The sleeve 32 is removably disposed within the nozzle port 28 with annular shoulder 52 of flange 51 resting against annular shoulder 48 of the nozzle port 28. The seal 38 is sized and configured to be compressed between the outer wall of first seal groove 40 of the nozzle port 28 and the sleeve outer wall 50 to substantially prevent drilling fluid flow between the sleeve 32 and the wall of nozzle port 28, while the fluid flows through sleeve bore 53.

The nozzle 34 includes an outer wall 54, external threads 56 on a portion thereof and an internal passageway or bore 57 through which drill fluid flows, bore 57 necking down at nozzle orifice 59. The nozzle 34 is removably insertable into the nozzle port 28 in longitudinally abutting relationship with sleeve 32 and is retained in nozzle port 28 by engagement of its threads 46 with threads 56. When the nozzle 34 is secured in the nozzle port 28, it secures and retains the sleeve 32 in nozzle port 28 by abutting annular shoulder 52 of the sleeve 32 against annular shoulder 48 of the bit body 11. The seal 36 is sized and configured to be compressed between the outer wall of second seal groove 42 of the nozzle port 28 and the nozzle outer wall 54 to substantially prevent drilling fluid flow between the nozzle 34 and the wall of nozzle port 28 while the fluid flows through nozzle bore 57. In this embodiment, fluid sealing is provided between the nozzle 34 and the wall of nozzle port 28 below the engaged threads 46 and 56, but the seal may be provided elsewhere along the outer wall 54 of nozzle 34 and wall of the nozzle port 28.

It should be noted that the components as described above are assembled at ambient atmospheric pressure, which may result in such pressure being trapped exterior to sleeve 32 and nozzle 34 and longitudinally between seals 36 and 38. Of course, when drill bit 10 is disposed downhole, hydrostatic pressure from the drilling fluid column above the bit as well as dynamic pressure from the drilling fluid being pumped through the drill bit will greatly exceed the trapped ambient pressure, potentially leading to at least partial extrusion of seals 36 and 38 out of grooves 42 and 40, respectively, due to the high pressure differential across seals 36 and 38. To alleviate this potential problem, a relief groove R, shown in FIG. 2 as a radially extending groove of arcuate, such as semicircular, cross-section extending through the longitudinal end surface of flange 51 may be provided. Of course, more than one such relief groove may be employed, and may comprise a groove or notch in the end of nozzle 34 abutting sleeve 32. As another option, one or more apertures may be formed through the wall of either sleeve 32 or nozzle 34, or both, at a location longitudinally between seals 36 and 38. Any of these configurations may, likewise, be employed with any embodiment of the invention, including without limitation the embodiment of FIG. 7.

The sleeve 32 and nozzle 34 may each comprise tungsten carbide material, as known to those of ordinary skill in the art, to provide high erosion resistance to the solids-laden drilling fluids being pumped through the nozzle assembly 30 at a high velocity. Optionally, other materials may be used for, or to line, the sleeve 32 or nozzle 34, such as other carbides or ceramic materials.

Optionally, threads 46 and 56 may be positioned relatively farther within nozzle port 28 and another annular seal groove (not shown) may be included in the upper portion of the nozzle port 28 of the bit body 11 above the mating threads 46 and 56 such that an additional seal may provide sealing for the threads 46 and 56 from debris or the drilling fluid to provide improved or unencumbered nozzle removal for nozzle replacement. Also, additional seal grooves may be utilized; however, there is a practical limit to the number of seal grooves utilizable to advantage without affecting other performance parameters such as the bit head's strength. Therefore, strategic placement of two or more grooves according to embodiments of the invention will beneficially enhance the sealing of the nozzle assembly parts in the bit head.

The seal grooves 42 and 40 are shown as open, annular channels of substantially rectangular cross section. However, the seal grooves 42 and 40 may have any suitable cross-sectional shape.

Figure 3:
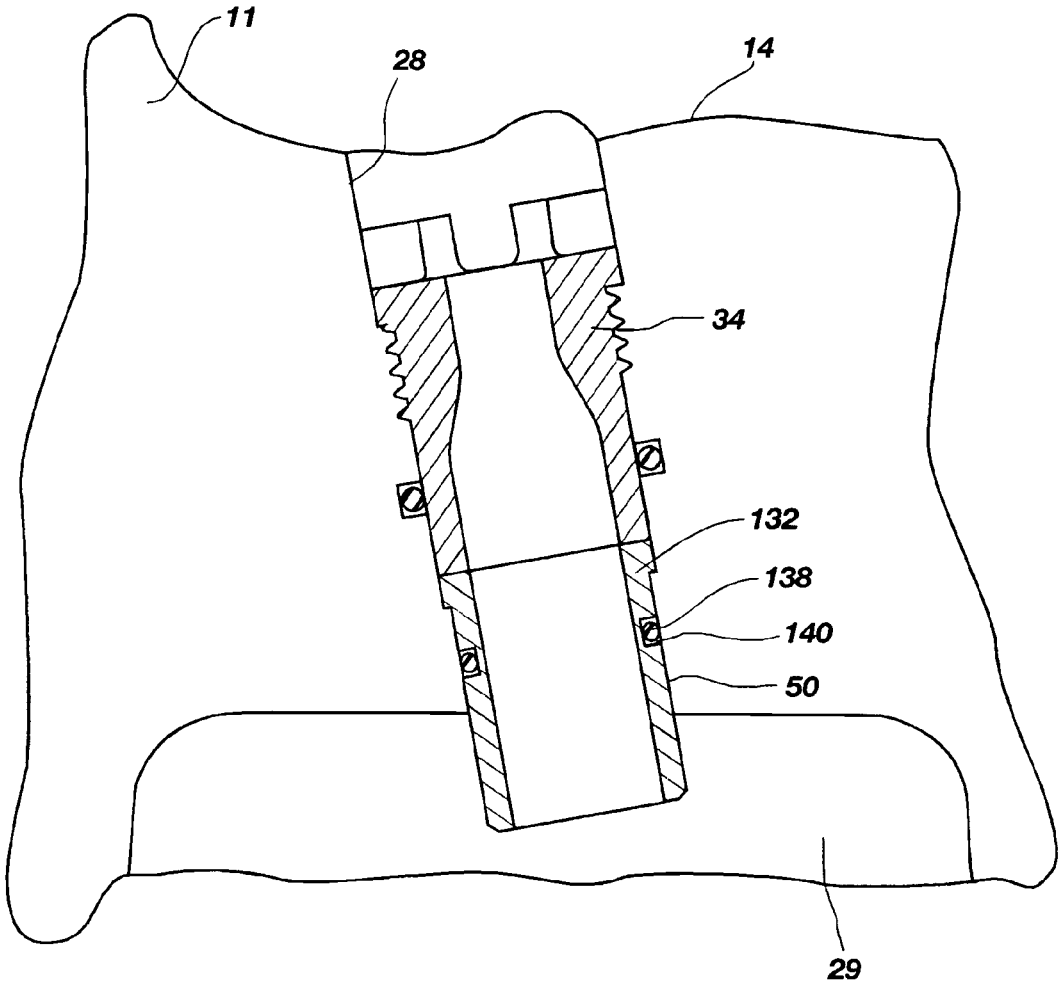
FIG. 3 shows a cross-sectional view of an embodiment of a nozzle assembly similar to that of FIG. 2 and employing a different sleeve and seal configuration, according to the invention.
Figure 4:
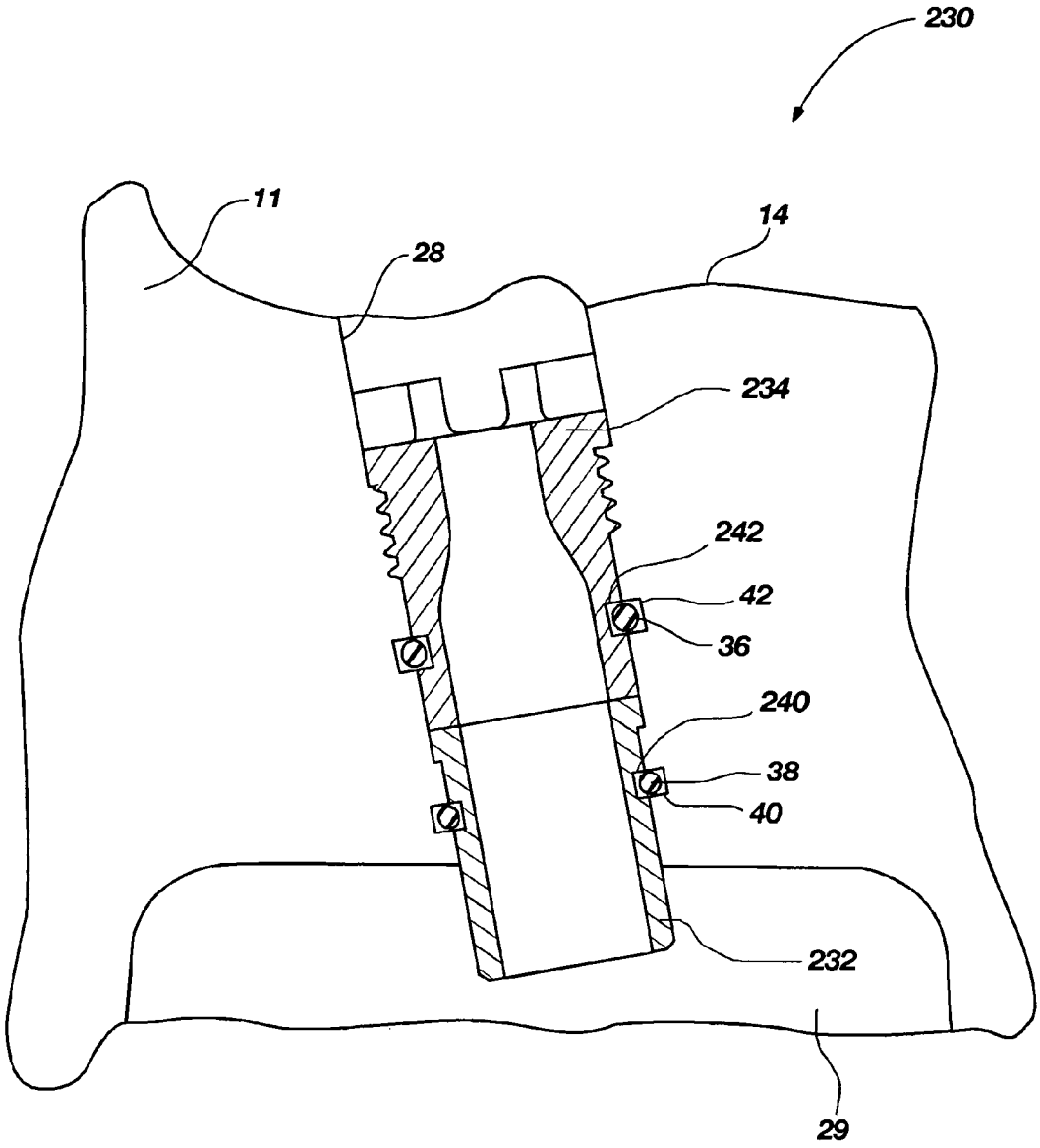
FIG. 4 shows a partial cross-sectional view of a further embodiment of a nozzle assembly according to the invention.

While the seal grooves 42 and 40 are each shown completely located within the material of the bit body 11 surrounding nozzle port 28, they may each optionally be located in the outer wall 54 of nozzle 34 and the outer wall 50 of sleeve 32, or formed partially within the material of bit body 11 surrounding nozzle port 28 and partially within the outer wall 54 of nozzle 34 and the outer wall 50 of sleeve 32, respectively, depending upon the type of seal used. For example, FIG. 3 shows a cross-sectional view of another embodiment of a nozzle sleeve 132. The nozzle sleeve 132 has a seal groove 140 located in the outer wall 50 sized and configured to receive a seal 138, and the nozzle thereabove may be similarly configured. FIG. 4 shows a partial cross-sectional view of a further embodiment of a nozzle assembly 230. The nozzle assembly 230 has seal groove segments 242 and 240 located in a nozzle 234 and in a sleeve 232, respectively, for cooperating alignment with seal groove segments 42 and 40 of nozzle port 28 for receiving seals 36 and 38 therein. However, it is anticipated in nozzle assembly designs, as described above, that an optimized location for the seal grooves 42 and 40 is in the material of the bit body 11 surrounding in the nozzle port 28 to minimize the design envelope required for a given nozzle and sleeve size with desired interior bore diameters and a sufficient wall thickness for sleeve 32 and nozzle 34. Further, such an approach will tend to minimize any damage to the seals during insertion thereof as well as during subsequent insertion of the sleeve and nozzle.

Figure 5:
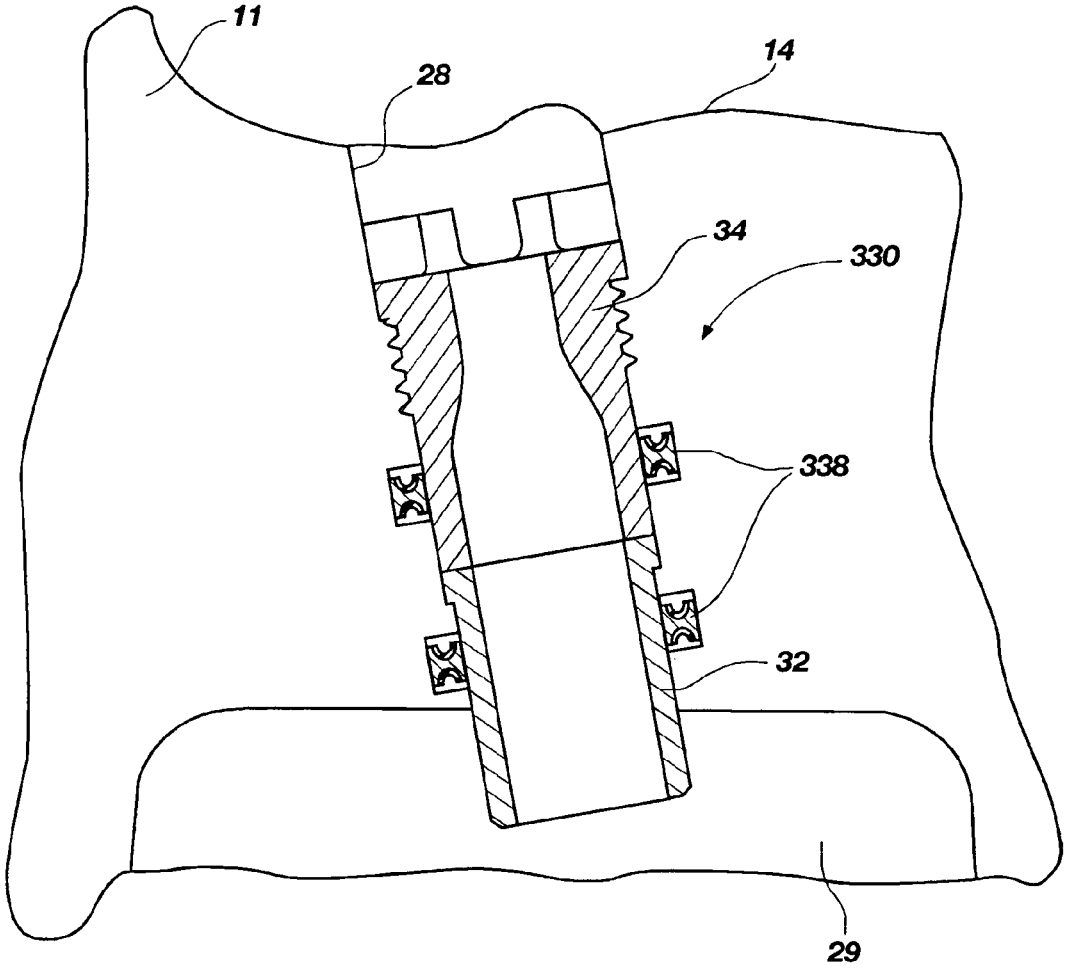
FIG. 5 shows a partial cross-sectional view of yet another embodiment of a nozzle assembly according to the invention.

The O-ring seals 36 and 38 provide a seal to prevent high pressure drilling fluid from bypassing the interior of the sleeve and flowing through any gaps 43, 44, 45 (see FIG. 2) at locations between components to eliminate the potential for erosion and while avoiding the need for the use of joint compound. The seals 36, 38 may each comprise an elastomer or other suitable, resilient seal material or combination of materials configured for sealing, when compressed, under high pressure within an anticipated temperature range and under environmental conditions (e.g., carbon dioxide, sour gas, etc.) to which drill bit 10 may be exposed for the particular application. Seal design is well-known to persons having ordinary skill in the art; therefore, a suitable seal material, size and configuration may easily be determined, and many seal designs will be equally acceptable for a variety of conditions. For example, without limitation, instead of an O-ring seal, a spring-energized seal or a pressure-energized seal may be employed. An example of the spring energized two direction seal 338 is shown in FIG. 5, which shows a partial cross-sectional view of yet another embodiment of a nozzle assembly 330, similar to the embodiment of the nozzle assembly 30 depicted in FIG. 2.

Figure 6:
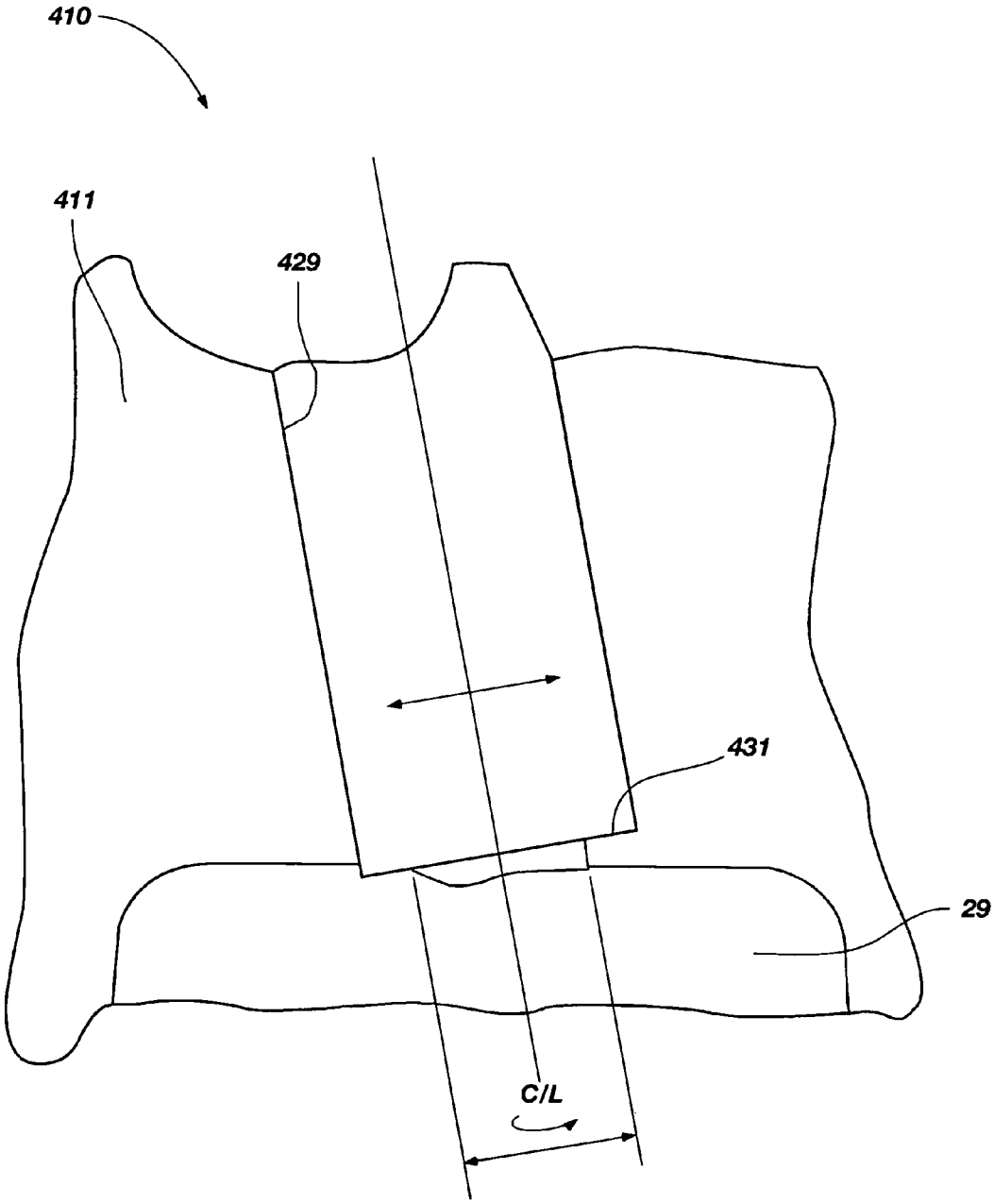
FIG. 6 shows a partial cross-sectional view of a steel body drill bit having an enlarged nozzle pocket configured for receiving a nozzle pocket insert assembly configured according to an embodiment of the invention.
Figure 7:
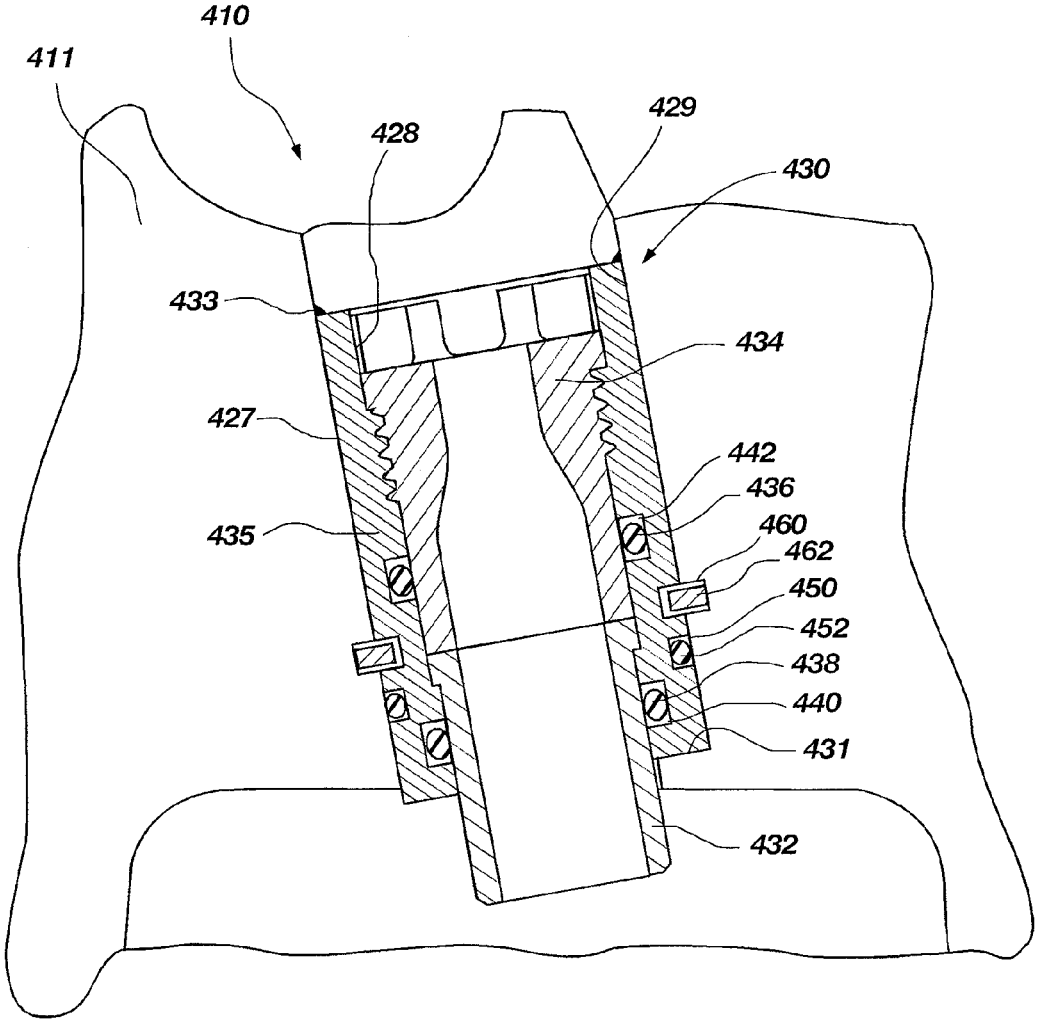
FIG. 7 shows a partial cross-sectional view of the steel body drill bit of FIG. 6 having a nozzle pocket insert assembly disposed and secured in the nozzle pocket.
Figure 8:
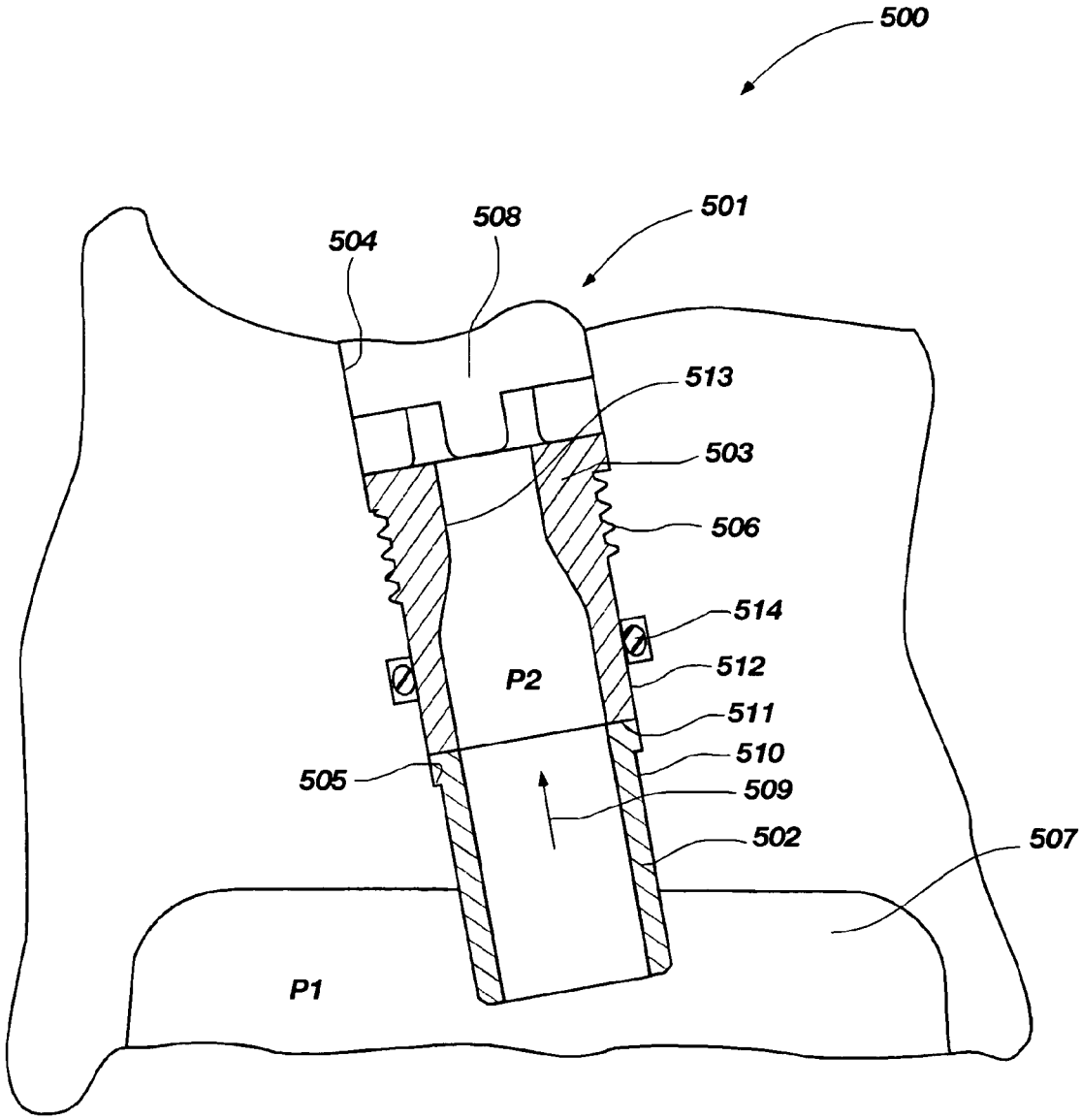
FIG. 8 (PRIOR ART)
FIG. 8 shows a conventional nozzle assembly for a steel body bit.

FIG. 6 and FIG. 7 will now be discussed. FIG. 6 shows a partial cross-sectional view of a steel body drill bit 410 having an enlarged nozzle port comprising a nozzle pocket 429 sized and configured for receiving a nozzle pocket insert assembly 430 in accordance with yet a further embodiment of the invention. FIG. 7 shows a partial cross-sectional view of the steel body drill bit 410 of FIG. 6 having the replacement nozzle assembly 430 disposed and secured therewithin.

The enlarged nozzle passage, or nozzle pocket, 429 extends linearly along centerline C/L. The nozzle pocket 429 is machined into the bit body 411 of the bit 410 to accommodate the nozzle pocket insert assembly 430, while allowing a sleeve 432 of the nozzle pocket insert assembly 430 to extend into the fluid cavity of the bit 410. The enlarged nozzle pocket 429 may desirably include a smaller counterbore at the lower end thereof bounded by annular shoulder 431. The annular shoulder 431 provides a step for stopping and supporting the nozzle pocket insert assembly 430. Once the nozzle pocket insert assembly 430 is located within the pocket 429, it may be secured within the nozzle pocket 429 by a continuous weld bead 433. Optionally, the assembly 430 may be secured by spot welding or the use of a snap-ring, or a circlip, without limitation, as would be recognized by a person having skill in the art. However, an additional seal and seal groove, as described below, would be desirably included between the exterior of assembly 430 and the wall of pocket 429 when the connection is not completely sealed, as would be obtained by the use of a continuous weld bead 433.

The nozzle pocket insert assembly 430 includes a steel nozzle pocket insert sleeve 435, a sleeve 432, a nozzle 434, two O-rings 436, 438, and seal grooves 442, 440. The insert sleeve 435 includes an interior bore 428 and an outer cylindrical wall 427. The outer cylindrical wall 427 is sized to be received within nozzle pocket 429 of the bit 410. The insert sleeve 435, in this embodiment, includes the seal grooves 442, 440 and, as mentioned herein, receives the sleeve 432, the nozzle 434, and the O-rings 436, 438. Additional elaboration is not necessary regarding the internal components of the nozzle pocket insert assembly 430 or their manner of disposition within nozzle pocket insert sleeve 435, as the details of such disposition as well as various options and embodiments of the structure thereof are described above. The nozzle pocket insert assembly 430 is suitable for retrofitting an existing bit or when repair or refurbishment is required. When a new drill bit is being made, it is anticipated that the embodiments of the invention mentioned above may be utilized.

Optionally, as mentioned above and in lieu of the use of welding, the outer cylindrical wall 427 of the insert sleeve 435 may include a retainer groove 460 and a resilient, radially expandable retainer 462, such as a clip or snap ring, for connecting and retaining the nozzle pocket insert assembly 430 in the nozzle pocket 429 of the body 411. In such an instance or if spot welding rather than an annular weld bead is employed to secure insert sleeve within nozzle pocket 429, the outer cylindrical wall 427 of the insert sleeve 435 may include an outer seal groove 450 and an outer annular seal 452 located in the outer seal groove 450 to provide a seal between the insert sleeve 435 and the wall of nozzle pocket 429 of the body 411. Of course, outer seal groove 450 may be machined in the wall of nozzle pocket 429.

A method of manufacturing or retrofitting a steel body bit 410 for receiving a nozzle pocket insert assembly 430 as shown in FIGS. 6 and 7 is now discussed. The method of manufacturing or retrofitting includes machining a nozzle pocket in a bit body, receiving the nozzle pocket insert assembly into the nozzle pocket and retaining the nozzle pocket insert assembly. It is desirable to axially align the machining process along the centerline of an intended nozzle port location to communicate with the internal fluid passage in the bit body. To facilitate placement and depth positioning of the nozzle pocket insert assembly, an initial smaller diameter port may be machined (if manufacturing a new bit), followed by boring the enlarged nozzle pocket coaxially therewith, and leaving an annular shoulder or lip at the bottom thereof surrounding the port communicating with the internal fluid passage of the bit body. If an existing steel body bit is under repair or replacement, the enlarged nozzle pocket may be bored along the path of an existing nozzle port. In either instance, the outer tubular sleeve is then disposed within the nozzle pocket and welded or otherwise retained therein, as described above. The O-rings or other seals as well as the sleeve and nozzle of erosion-resistant material may then be inserted into the tubular outer sleeve, and the threads on the nozzle engaged and made up with those on the inner wall of the tubular outer sleeve. Subsequently, the sleeve, nozzle and O-rings or other seals may be replaced as necessary or desirable, as in the case wherein a nozzle may be changed out for one with a different orifice size.

While particular embodiments of the invention have been shown and described, numerous additions, deletions and modifications to the disclosed embodiments will be readily apparent to one of ordinary skill in the art. Accordingly, it is intended that the invention only be limited in scope by the appended claims.

What is claimed is:

1. A nozzle pocket insert assembly for use with a steel body bit, the nozzle pocket insert assembly comprising:

a substantially tubular outer sleeve having threads formed on an inner wall of the substantially tubular outer sleeve;

a substantially tubular nozzle comprising an erosion-resistant material and disposed in the substantially tubular outer sleeve proximate an exterior surface of a steel bit body, wherein threads formed on an outer wall of the substantially tubular nozzle at least partially engage with the threads of the substantially tubular outer sleeve;

a substantially tubular sleeve comprising an erosion-resistant material and disposed in the substantially tubular outer sleeve in longitudinally adjacent substantially abutting relationship to the substantially tubular nozzle;

an annular groove formed in at least one of an inner wall of the substantially tubular outer sleeve laterally adjacent the substantially tubular nozzle and an outer wall of the substantially tubular nozzle;

another annular groove formed in at least one of the inner wall of the substantially tubular outer sleeve laterally adjacent the substantially tubular sleeve and an outer wall of the substantially tubular sleeve;

a further annular groove formed in an outer wall of the substantially tubular outer sleeve; and at least one annular seal disposed in the annular groove, at least another annular seal disposed in the another annular groove, and a further annular seal disposed in the further annular groove, wherein the further annular seal is configured to be in sealing engagement with a wall of a nozzle pocket formed in the steel bit body.

2. The nozzle pocket insert assembly of claim 1, wherein the annular groove and the another annular groove are formed in the inner wall of the substantially tubular outer sleeve.

3. The nozzle pocket insert assembly of claim 1, wherein the threads of the substantially tubular outer sleeve are formed between the annular groove and one end of the substantially tubular outer sleeve.

4. The nozzle pocket insert assembly of claim 1, wherein the erosion-resistant material of the substantially tubular nozzle and the substantially tubular sleeve is selected from the group consisting of a metal carbide and a ceramic.

5. The nozzle pocket insert assembly of claim 1, wherein the erosion-resistant material of the substantially tubular nozzle and the substantially tubular sleeve comprises tungsten carbide.

6. The nozzle pocket insert assembly of claim 1, wherein the annular seals comprise at least one elastomer.

7. The nozzle pocket insert assembly of claim 1, wherein the annular grooves are of substantially rectangular transverse cross-section.

8. The nozzle pocket insert assembly of claim 1, wherein the substantially tubular sleeve comprises an annular flange at one end thereof, and the annular flange abuts an annular shoulder formed in the inner wall of the substantially tubular outer sleeve.

9. The nozzle pocket insert assembly of claim 8, wherein a portion of the substantially tubular sleeve extends beyond an end of the substantially tubular outer sleeve.

10. The nozzle pocket insert assembly of claim 1, further including a steel bit body with a nozzle pocket formed therein, wherein the substantially tubular outer sleeve is disposed in the nozzle pocket with the annular seal carried in the annular groove in the outer wall of the substantially tubular outer sleeve in sealing engagement with a wall of the nozzle pocket.

11. The nozzle pocket insert assembly of claim 1, wherein an outer wall of the substantially tubular outer sleeve includes an annular retainer groove therein, and further comprising a resilient, radially expandable retainer disposed therein.

12. The nozzle pocket insert assembly of claim 11, further including a steel bit body with a nozzle pocket formed therein, wherein the substantially tubular outer sleeve is disposed in the nozzle pocket with a portion of the radially expandable annular retainer received in an annular retainer groove formed in a wall of the nozzle pocket.

13. The nozzle pocket insert assembly of claim 1, further comprising a steel bit body having a nozzle pocket formed therein, the substantially tubular outer sleeve being received in the nozzle pocket, and secured therein by at least one weld between an end of the substantially tubular outer sleeve and the steel bit body.

14. The nozzle pocket insert assembly of claim 13, wherein the at least one weld comprises an annular weld bead between the end of the substantially tubular outer sleeve and the steel bit body.

15. The nozzle pocket insert assembly of claim 13, wherein the nozzle pocket comprises an annular shoulder proximate an inner end thereof, and another end of the substantially tubular outer sleeve abuts the annular shoulder.

16. The nozzle pocket insert assembly of claim 13, wherein the substantially tubular outer sleeve comprises one of a steel and a stainless steel.

17. The nozzle pocket insert assembly of claim 1, further comprising at least one relief groove or aperture extending between an exterior and an interior of at least one of the substantially tubular sleeve and the substantially tubular nozzle longitudinally between the at least one annular seal and the at least another annular seal.

18. A nozzle pocket insert assembly for use with a subterranean drill bit, the nozzle pocket insert assembly comprising:

a unitary, substantially tubular outer sleeve;

a substantially tubular nozzle comprising an erosion-resistant material and disposed in the substantially tubular outer sleeve proximate an exterior surface of a steel bit body;

a substantially tubular sleeve comprising an erosion-resistant material and disposed in the substantially tubular outer sleeve in longitudinally adjacent substantially abutting relationship to the substantially tubular nozzle;

an annular groove formed in at least one of an inner wall of the substantially tubular outer sleeve and an outer wall of the substantially tubular nozzle;

another annular groove formed in the inner wall of the substantially tubular outer sleeve; and at least one annular seal disposed in the annular groove, at least another annular seal disposed in the another annular groove, and a further annular seal disposed in a further annular groove formed in an outer wall of the substantially tubular outer sleeve.

19. A nozzle pocket insert assembly for use with a subterranean drill bit, the nozzle pocket insert assembly comprising:

a substantially tubular nozzle comprising an erosion-resistant material;

a substantially tubular sleeve comprising an erosion-resistant material and an annular flange at an end thereof;

a substantially tubular outer sleeve having the substantially tubular nozzle and the substantially tubular sleeve disposed therein, wherein an end of the substantially tubular nozzle abuts the end of the substantially tubular sleeve comprising the annular flange, the substantially tubular outer sleeve comprising:

a first end sized and configured to be positioned adjacent to an exterior surface of a bit body and to enable the substantially tubular nozzle to be inserted into the substantially tubular outer sleeve through an opening in the first end;

an opposing, second end configured to be positioned proximate to a drilling fluid chamber within the bit body; and an annular shoulder formed in the inner wall of the substantially tubular outer sleeve proximate to the second end, a portion of the annular shoulder abutting a portion of the annular flange of the substantially tubular sleeve;

an annular groove formed in at least one of an inner wall of the substantially tubular outer sleeve and an outer wall of the substantially tubular nozzle;

another annular groove formed in the inner wall of the substantially tubular outer sleeve; and at least one annular seal disposed in the annular groove and at least another annular seal disposed in the another annular groove.

20. The nozzle pocket insert assembly of claim 19, wherein an outer wall of the substantially tubular outer sleeve includes an annular groove therein, and further comprising an annular seal disposed therein.

* * * * *